US010173759B1

(12) United States Patent
Castro-Feliciano

(10) Patent No.: US 10,173,759 B1
(45) Date of Patent: Jan. 8, 2019

(54) BUOYANCY CONTROL SYSTEM USING COMBUSTION

(71) Applicant: The United States of America as Represented by the Secretary of the Navy, Washington, DC (US)

(72) Inventor: Esteban Luis Castro-Feliciano, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/789,050

(22) Filed: Oct. 20, 2017

(51) Int. Cl.

| | |
|---|---|
| ***B63G 8/14*** | (2006.01) |
| ***B63G 8/22*** | (2006.01) |
| ***F02B 61/00*** | (2006.01) |
| ***F02D 37/02*** | (2006.01) |
| ***F02D 29/02*** | (2006.01) |
| *F02D 28/00* | (2006.01) |

(52) U.S. Cl.
CPC ..... *B63G 8/14* (2013.01); *B63G 8/22* (2013.01); *F02B 61/00* (2013.01); *F02D 29/02* (2013.01); *F02D 37/02* (2013.01); *F02D 28/00* (2013.01)

(58) Field of Classification Search
CPC ... B63G 8/00; B63G 8/08; B63G 8/14; B63G 8/22; B63G 8/24
USPC ..... 114/331
See application file for complete search history.

(56) References Cited

U.S. PATENT DOCUMENTS

| | | | | |
|---|---|---|---|---|
| 1,382,073 A * | 6/1921 | Fort | B63G 8/22 114/331 |
| 8,069,808 B1 * | 12/2011 | Imlach | B63G 8/22 114/331 |
| 2009/0178603 A1 * | 7/2009 | Imlach | B63G 8/22 114/331 |

* cited by examiner

*Primary Examiner* — Lars A Olson
(74) *Attorney, Agent, or Firm* — James T. Shepherd

(57) ABSTRACT

A combustion buoyancy control system for a submersible object is provided. The buoyancy control system includes a piston cylinder and a piston defining a combustion chamber. An oxidizer inlet introduces oxidizer into the combustion chamber. A fuel injector and igniter device injects fuel into the combustion chamber so that it mixes with the oxidizer in the combustion chamber and then ignites the mixture of oxidizer and fuel in the combustion chamber to produce combustion. Combustion within the combustion chamber displaces the piston member in a first direction causing an increase in the volume of the combustion chamber which increases the buoyancy of the submersible object. Displacement of the piston member in a second opposite direction causes a decrease in the volume of the combustion chamber which in turn decreases the buoyancy of the submersible object.

20 Claims, 7 Drawing Sheets

BUOYANCY CONTROL SYSTEM USING COMBUSTION

STATEMENT OF GOVERNMENT INTEREST

The invention described herein may be manufactured and used by or for the Government of the United States of America for governmental purposes without the payment of any royalties.

FIELD OF THE INVENTION

The present invention relates to a buoyancy control system for a submersible object wherein the buoyancy control system utilizes combustion.

BACKGROUND

Buoyancy engines are in widespread use in submersible vehicles and objects such as underwater gliders or underwater drones. Buoyancy engines cause a change of volume displacement, thus vehicle density change. The volumetric change is usually done by either an electric actuator, compressed gas or by the thermodynamic change of a material. Electric actuators, although efficient within deeper waters, still require non-rechargeable lithium batteries to maintain high-endurance and thus are very costly due to frequent battery replacement. Moreover, lithium-ion batteries are very dense, requiring the submersible vehicle to compensate with empty volume to maintain neutral buoyancy underwater. Other conventional buoyancy control systems utilize compressed air. Although compressed air has specific energy and density that are significantly lower than that of lithium-ion batteries, such systems require onboard air compressors and electrical energy storage devices to power the onboard air compressors. Thus, for endurance missions, buoyancy control systems using compressed air are actually inferior to buoyancy control systems using electric actuators. Another conventional buoyancy control system is the thermal powered buoyancy engine which is used in the Slocum Thermal Glider. However, thermal powered buoyancy engines rely only on the temperature change caused by the thermocline ocean layer. Thus, such thermal powered buoyancy engines restrict the submersible vehicle's depth and/or location of operation.

What is needed is a new and improved buoyancy control system for submersible objects that eliminates the problems and disadvantages associated with conventional buoyancy control systems.

SUMMARY OF THE INVENTION

Accordingly, it is an object of the present invention to provide a buoyancy control system for a submersible object.

Another object of the present invention is to provide a buoyancy control system that is energy and cost efficient.

Other objects and advantages of the present invention will become more obvious hereinafter in the specification and drawings.

Thus in one aspect, the present invention is directed to a buoyancy control system for a submersible object that is configured for submergence in an ambient fluid. The buoyancy control system has a piston cylinder and a piston member that includes a piston portion and a shaft portion attached to the piston portion. The piston portion is supported within the piston cylinder such that the piston portion and piston cylinder define a combustion chamber. The volume of the combustion chamber is determined by the position of the piston portion within the piston cylinder. An oxidizer inlet is attached to the piston cylinder to introduce oxidizer into the combustion chamber. A fuel injector and igniter device is attached to the piston cylinder to inject fuel into the combustion chamber so that it mixes with the oxidizer in the combustion chamber and to ignite the mixture of oxidizer and fuel in the combustion chamber to produce combustion. An exhaust outlet is attached to the piston cylinder to vent combustion gases from the combustion chamber. Combustion within the combustion chamber displaces the piston member in a first direction causing an increase in the volume of the combustion chamber which in turn increases the buoyancy of the submersible object. Displacement of the piston member in a second opposite direction causes a decrease in the volume of the combustion chamber which in turn decreases the buoyancy of the submersible object.

DETAILED DESCRIPTION OF THE INVENTION

As used herein, the term "submersible object" includes, but is not limited to, autonomous underwater vehicles (AUV), underwater gliders, underwater drones, miniature or midget submarines and mini-submersible vehicles.

Figure 1:
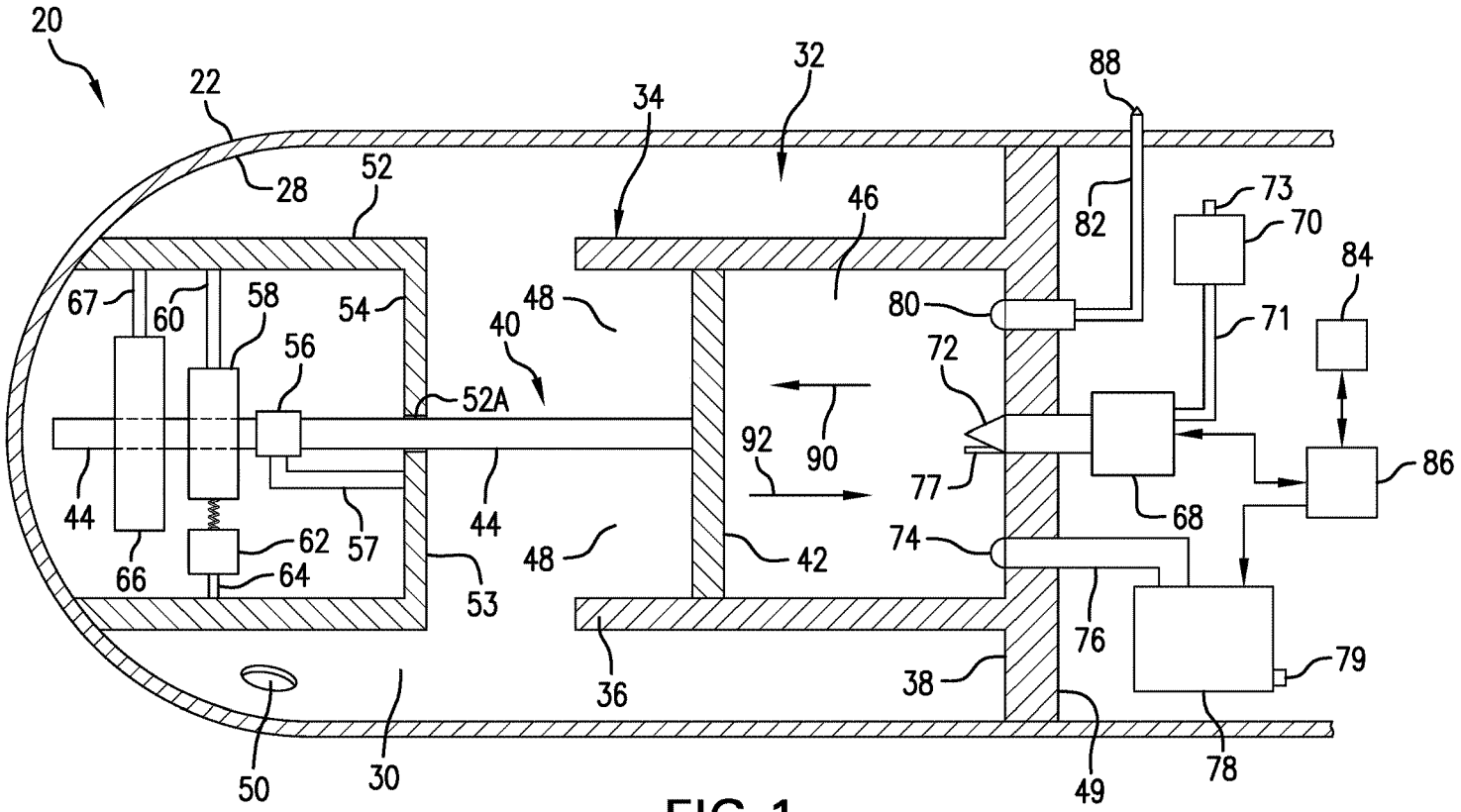
FIG. 1 is a cross-sectional view of a portion of a submersible object utilizing a buoyancy control system in accordance with an embodiment of the present invention.

Referring to FIG. 1, there is shown a submersible object 20 that incorporates a buoyancy control system 32 in accordance with an exemplary embodiment of the present invention. In this embodiment, submersible object 20 is a glider. As is well known in the art, gliders have fins or wings, but these features are not shown in FIG. 1 since they are not pertinent to the present invention. Instead, FIG. 1 shows a portion of submersible object 20. Submersible object 20 includes hull 22 which has interior wall 28. Submersible object 20 includes forward area or chamber 30. Buoyancy control system 32 includes piston assembly 34. Piston assembly 34 includes piston cylinder 36 and piston member 40. Piston member 40 includes piston portion 42 and shaft portion 44 that is attached to the piston portion 42. Piston portion 42 is supported within piston cylinder 36 such that piston portion 42 and piston cylinder 36 define combustion chamber 46 and ambient chamber 48. Combustion chamber 46 has a volume that is determined by the position of piston portion 42 within piston cylinder 36. In an exemplary embodiment, piston cylinder 36 comprises bulkhead 49. Bulkhead 49 is attached or joined to interior wall 28 of hull 22. In one embodiment, bulkhead 49 is annular in shape. Hull 22 includes opening 50 which leads to the sea or an external body of water or ambient fluid in which submersible object 20 operates. For example, sea or ocean water can flow through opening 50 and into forward chamber 30 and also can flow out through opening 50 and back into the sea or ambient fluid. As will be described in the ensuing description, opening 50 can be plugged or capped in other embodiments.

Referring still to FIG. 1, shaft portion 44 extends into housing 52 through opening 52A in housing wall 53. Housing 52 is watertight and is attached or joined to interior wall 28 of hull 22. A seal (not shown) is positioned in opening 52A and allows axial movement of shaft portion 44 but prevents ambient fluid leaking into the interior of housing 52. Buoyancy control system 32 further includes position sensor 56, brake mechanism 58, brake control device 62 and actuator device 66, all of which are located within housing 52. Position sensor 56 is attached to support member 57 which is attached to interior wall 54 of housing 52. Brake mechanism 58 is supported by support member 60 which is attached to interior wall 54 of housing 52. As will be explained in the ensuing description, brake mechanism 58, when activated, secures the position of piston portion 42. In an exemplary embodiment, brake mechanism 58 is a ratchet-type brake. In another exemplary embodiment, brake mechanism 58 is a compression-type brake with on/off control. Other suitable brake mechanisms may be used as well. Brake control device 62 is supported by support member 64 which is attached to interior wall 54. Actuator device 66 is supported by support member 67 which is attached to interior wall 54. Since housing 52 is watertight, all components therein are protected from fluid, e.g. sea water. The functions of the aforementioned components are discussed in detail in the ensuing description.

Buoyancy control system 32 further includes computer or controller 86 which may be a general purpose computing device that executes a computer program. In an exemplary embodiment, computer or controller 86 includes a programmable microprocessor with sufficient processing capability and data memory storage. Referring to FIG. 1, computer 86 is in electronic signal communication with position sensor 56, brake control device 62 and actuator device 66 via a water-proof electrical wire network (not shown). Position sensor 56 is used in combination with brake control device 62, actuator 66 and computer 86 to set the desired initial position of piston portion 42 within piston cylinder 36 and to assist in introducing oxidizer (e.g., air) into combustion chamber 46 and dispelling exhaust out of combustion chamber 46. Position sensor 56 detects the position of shaft portion 44 and outputs an electronic signal that represents the position of shaft portion 44. The electronic signals that represent the position of shaft portion 44 are inputted into computer 86. Computer 86 then processes these electronic signals to determine the location of piston portion 42 within piston cylinder 36. Brake control device 62 receives control signals from computer 86. These control signals cause brake control device 62 to either activate brake mechanism 58 to stop movement of shaft portion 44 or to release brake mechanism 58 so as to allow movement of shaft portion 44. Actuator device 66 also receives control signals from computer 86. When brake mechanism 58 is released, actuator device 66 is able to push shaft portion 44 so that piston portion 42 is moved deeper into piston cylinder 36. When brake mechanism 58 is released, actuator device 66 is also able to pull shaft portion 44 in the opposite direction so that piston portion 42 is pulled away from bulkhead 49. Position sensor 56 continuously sends electronic signals to computer 86 that indicate the position of shaft portion 44. When shaft portion 44 is at the desired position, then computer 86 sends electronic signals to the brake control device 62 and actuator device 66 that turns off actuator device 66 and activates brake mechanism 58 to stop further movement of shaft portion 44.

Buoyancy control system 32 further includes oxidizer inlet 74 that is attached to bulkhead 49 and protrudes into combustion chamber 46. Oxidizer inlet 74 introduces oxidizer into combustion chamber 46. In an exemplary embodiment, the oxidizer is air. Oxidizer conduit 76 is connected between oxidizer inlet 74 and oxidizer tank 78 which contains compressed oxidizer. Oxidizer tank 78 includes valve 79 which allows oxidizer tank 78 to be replenished with oxidizer. In one embodiment, oxidizer tank 78 is controlled by electrical signals sent by computer 86. Upon receiving these electrical control signals, oxidizer tank 78 provides oxidizer to oxidizer inlet 74. If submersible object 20 does not surface, then oxidizer tank 78 will have to be eventually replenished via valve 79 when submersible 20 ascends to the surface. Once submersible object 20 surfaces, compressed oxidizer is pumped into oxidizer tank 78. If the oxidizer is air, then compressed air is then pumped into tank 78.

Figure 7:
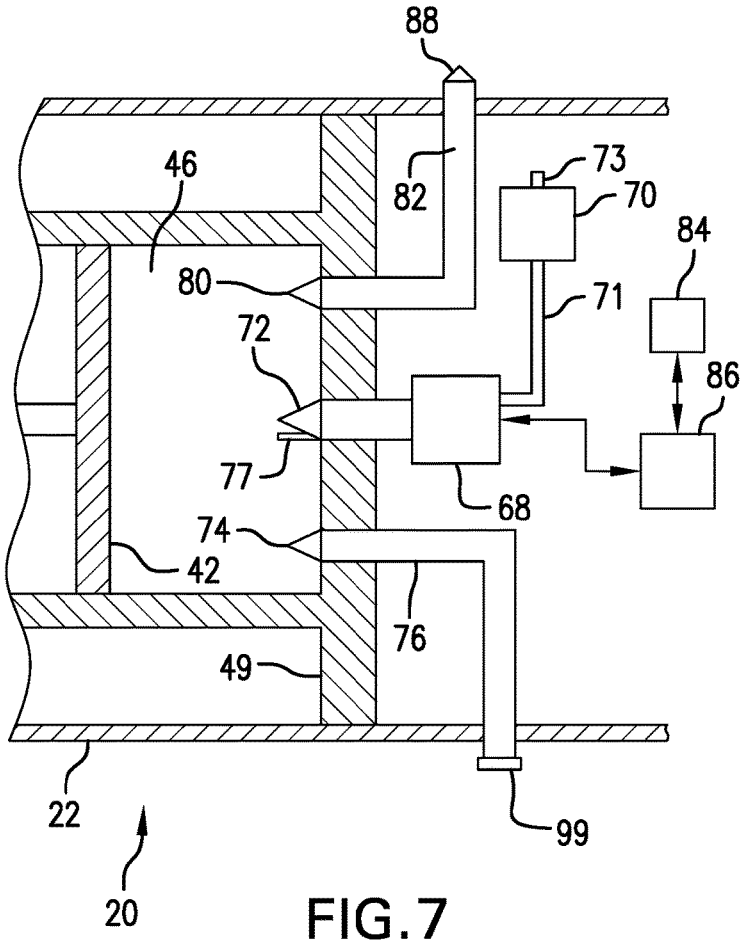
FIG. 7 is a cross-sectional view of a portion the submersible object utilizing the buoyancy control system in accordance with another embodiment of the invention, the buoyancy control system utilizing a natural aspiration configuration to introduce air into the combustion chamber.

In another embodiment, submersible object 20 is naturally aspirated. This is illustrated in FIG. 7. In such an embodiment, tank 78 and valve 79 are not used. Instead, oxidizer conduit 76 extends through hull 22 to the outside of submersible object 20. One-way valve 99 is attached to the opening of oxidizer conduit 76. When submersible object 20 surfaces, computer 86 outputs electrical signals to actuator device 66 to cause actuator device 66 to pull piston portion 42 in direction 90 in order to draw fresh air into combustion chamber 46. As piston portion 42 is moving in direction 90, suction is created which sucks fresh air into one-way valve 99. This fresh air flows through oxidizer conduit 76 and into combustion chamber 46.

Buoyancy control system 32 further includes fuel pump 68 and fuel tank 70. Fuel tank 70 holds an amount of fuel that is used by fuel pump 68. Fuel tank 70 delivers the fuel to fuel pump 68 via fuel line 71. Fuel pump 70 can be replenished with fuel via valve 73. In an exemplary embodiment, the fuel is diesel fuel. Fuel pump 68 includes fuel injector 72 and igniter device 77. Fuel pump 68, fuel injector 72 and igniter device 77 are all controlled by electrical signals generated by computer 86. Fuel injector 72 and igniter device 77 are attached to bulkhead 49 and protrude into combustion chamber 46. Upon receiving the appropriate electrical control signal from computer 86, fuel injector 72 injects fuel into combustion chamber 46 so that it mixes with the oxidizer introduced into combustion chamber 46 by oxidizer inlet 74. Computer 86 also outputs electrical signals that cause igniter device 77 to ignite the mixture of fuel and oxidizer in combustion chamber 46. Exhaust outlet 80 is attached to bulkhead 49 and protrudes into combustion chamber 46. Exhaust conduit 82 is connected between exhaust outlet 80 and exhaust port 88 that is attached to hull 22. Exhaust outlet 80 vents combustion gasses within combustion chamber 46. The combustion gases pass through exhaust conduit 82 to exhaust port 88. If submersible object 20 is submersed in a fluid, then the exhaust gases exit exhaust port 88 as bubbles. If submersible object 20 is not submerged, then the exhaust gases exit exhaust port 88 and directly enter the atmosphere. Actuator device 66 and brake mechanism 58 assist in the removal of exhaust from combustion chamber 46 as will be explained in the ensuing description. Combustion within combustion chamber 46 pushes piston portion 42 in first direction 90 thereby causing an increase in the volume of combustion chamber 46 which in turn increases the buoyancy of submersible object 20. Movement of piston portion 42 in opposite second direction 92 decreases the volume of combustion chamber 46 which in turn decreases the buoyancy of submersible object 20. The operation of buoyancy control system 32 is discussed in detail in the ensuing description.

In order for submersible object 20 to dive or descend, piston portion 42 must be set at an initial position in the piston cylinder 36 in order to optimize the fuel efficiency for the desired dive depth. Exhaust outlet 80 is open while piston portion 42 is being set at the initial position in piston cylinder 36. Therefore, at this time, combustion chamber 46 is at ambient pressure. In order to set piston portion 42 at the desired initial position, computer 86 generates electrical signals for brake control device 62 and actuator device 66. In response to these electrical signals, brake control device 62 releases brake mechanism 58 which allows actuator device 66 to push piston portion 42 into the piston cylinder 36 to the desired position within piston cylinder 36. In this embodiment, brake control device 62 is controlled by computer 86. However, in other embodiments, brake control device 62 and actuator device 66 are mechanically activated.

Once piston portion 42 is at the desired pre-defined, optimal, initial position, computer 86 sends a signal to the brake control device 62. In response, brake control device 62 engages brake mechanism 58 so as to prevent further movement of piston portion 42 in direction 92. At this point, submersible object 20 is in the process of diving or descending. As submersible object 20 dives, brake mechanism 58 prevents piston portion 42 from moving deeper into piston cylinder 36 beyond the pre-defined, optimal, initial position. If piston portion 42 was allowed to move deeper into piston cylinder 36 during a dive, then a longer combustion period would be required in order to displace piston portion 42 in the opposite direction in order for submersible object 20 to ascend. Thus, preventing piston portion 42 from moving deeper into piston cylinder 36 beyond the pre-defined, optimal, initial position during descent will conserve energy when it is time for the submersible object to surface.

In an exemplary embodiment, once piston portion 42 is set at the pre-defined, optimal, initial position, computer 86 sends a signal to tank 78 which, in response, provides oxidizer to combustion chamber 46. As a result, the required oxidizer is present in the chamber and ready for combustion which is to occur later in time. It is to be understood that buoyancy control system 32 uses oxidizer tank 78 when submersible object 20 is to remain underwater for several ascent/descent cycles without surfacing on ascent. When submersible object 20 ascends, without surfacing, piston portion 42 is displaced in opposite second direction 92 to push out all of the exhaust gases in combustion chamber 46 through exhaust outlet 88. Then, computer 86 sends a signal to tank 78 to cause tank 78 to provide oxidizer to combustion chamber 46 and piston portion 42 would once again be set to the initial, optimal dive position within piston cylinder 36. The air in combustion chamber 46 is at ambient pressure. In the case wherein buoyancy control system 32 is naturally aspirated as described in the foregoing description and shown in FIG. 7, submersible vehicle 20 would surface and piston portion 42 would be displaced in opposite second direction 92 to push out the exhaust gases through exhaust port 88. In the "naturally aspirated" embodiment, oxidizer conduit 76 extends outside of hull 22 and includes one-way valve 99. As piston portion 42 is displaced in direction 90, negative pressure is created in combustion chamber 46 which causes air to rush into the one-way valve 99, pass through oxidizer conduit 76 and enter combustion chamber 46. Piston portion 42 is then once again set to the initial, optimal position within piston cylinder 36. Thus, the air will already be present in combustion chamber 46 prior to combustion.

As shown in FIG. 1, buoyancy control system 32 further includes depth sensor 84. In an exemplary embodiment, depth sensor 84 is programmed to output an alert signal to computer 86 when submersible object 20 reaches a desired depth.

In order to increase buoyancy of submersible object 20 so that it ascends, computer 86 sends electrical signals to fuel pump 68. In response, fuel injector 72 emits a mist of diesel fuel into combustion chamber 46 which then mixes with the oxidizer in combustion chamber 46. Ignitor device 77 then ignites the mixture of oxidizer and the mist of diesel fuel in order to produce combustion. The resultant intense heat and pressure in combustion chamber 46 displaces piston portion 42 in direction 90 so as to increase the volume in combustion chamber 46. As the volume in combustion chamber 46 increases, the buoyancy of submersible object 20 increases. Also, as piston portion 42 moves outward in direction 90, the sea water or ambient fluid is displaced from ambient chamber 48. This causes the sea water or ambient fluid to flow out of forward chamber 30 through opening 50. During ascent, brake control device 62 releases brake mechanism 58 to allow shaft portion 44 to move freely in direction 90 so as to allow the continued increase in volume in combustion chamber 46 so as to further increase buoyancy. Brake control device 62 is configured to control brake mechanism 58 to allow movement of shaft portion 44 in direction 90 during combustion but not allow movement of shaft portion 44 in direction 92. This configuration prevents piston portion 42 from moving deeper into piston cylinder 36 while the submersible object 20 is ascending. In an alternate embodiment, computer 86 is programmed to output control signals that cause brake control device 62 to control brake mechanism 58 to allow movement of shaft portion 44 in direction 90 for only a predetermined distance if additional buoyancy is not required to ascend. In alternate embodiments, the fuel could be injected into combustion chamber 46 before or during the descent to facilitate better mixing of oxidizer and fuel.

After submersible object 20 reaches the top of the ascent, the exhaust in combustion chamber 46 is vented by exhaust outlet 80 with the assistance of actuator device 66. Specifically, computer 86 generates electrical signals for input into brake control device 62 and actuator device 66 that cause brake control device 62 to release brake mechanism 58 and actuator device 66 to push piston portion 42 deeper into piston cylinder 36 so that the exhaust gases exit combustion chamber 46 through exhaust outlet 80 and then flow through exhaust conduit 82. The exhaust gases then exit submersible object 20 via exhaust portion 88.

The combustion produced in combustion chamber 46 is the result of a controlled process that ensures the correct and efficient expansion of the volume in combustion chamber 46. Thus, the combustion in combustion chamber 46 does not need to be as quick as in a conventional combustion engine.

Figure 2:
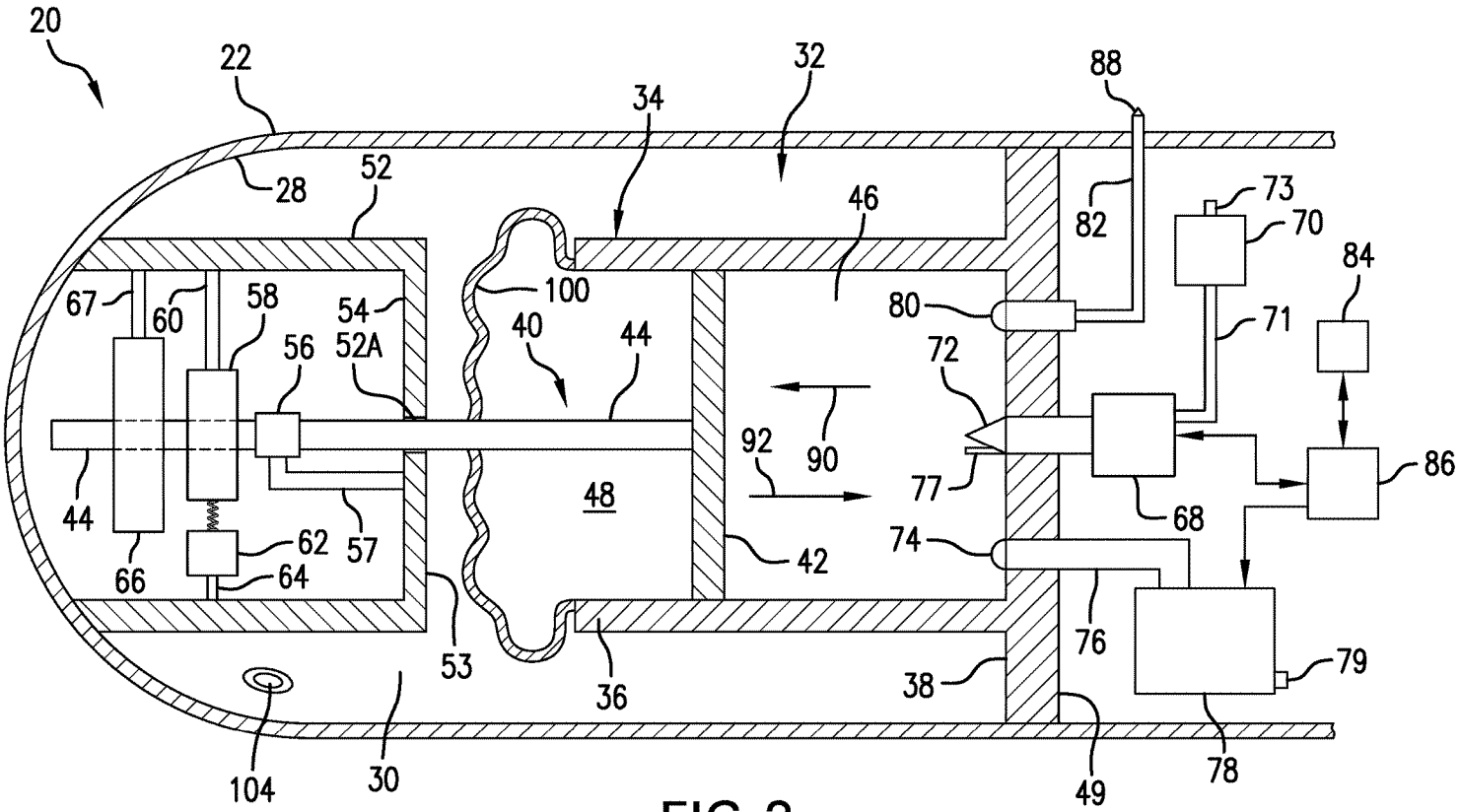
FIG. 2 is a cross-sectional view of the same portion of the submersible object of FIG. 1 wherein the buoyancy control system includes an expandable bladder in accordance with another embodiment of the present invention.

Referring to FIG. 2, buoyancy control system 32 may optionally use expandable bladder 100 which is shown in cross-section. Expandable bladder 100 is attached, joined or sealed to piston cylinder 36 so that the opening of expandable bladder 100 is in fluid communication with ambient region 48. In this embodiment, cap or plug 104 closes off opening 50 in forward section 30 and there is no sea water or ambient fluid in forward section 30. A predetermined amount of incompressible fluid is within ambient chamber 48 and is pushed into expandable bladder 100 when piston portion 42 is displaced in direction 90. Expandable bladder 100 expands as the incompressible fluid flows therein. When piston portion 42 is displaced in opposite second direction 92, the incompressible fluid flows from expandable bladder 100 back into ambient chamber 48. As the incompressible fluid leaves expandable bladder 100, the expandable bladder 100 slowly collapses. Expandable bladder 100 is made from any suitable material that allows for repeated expansion and collapse with minimal resistance.

Figure 3:
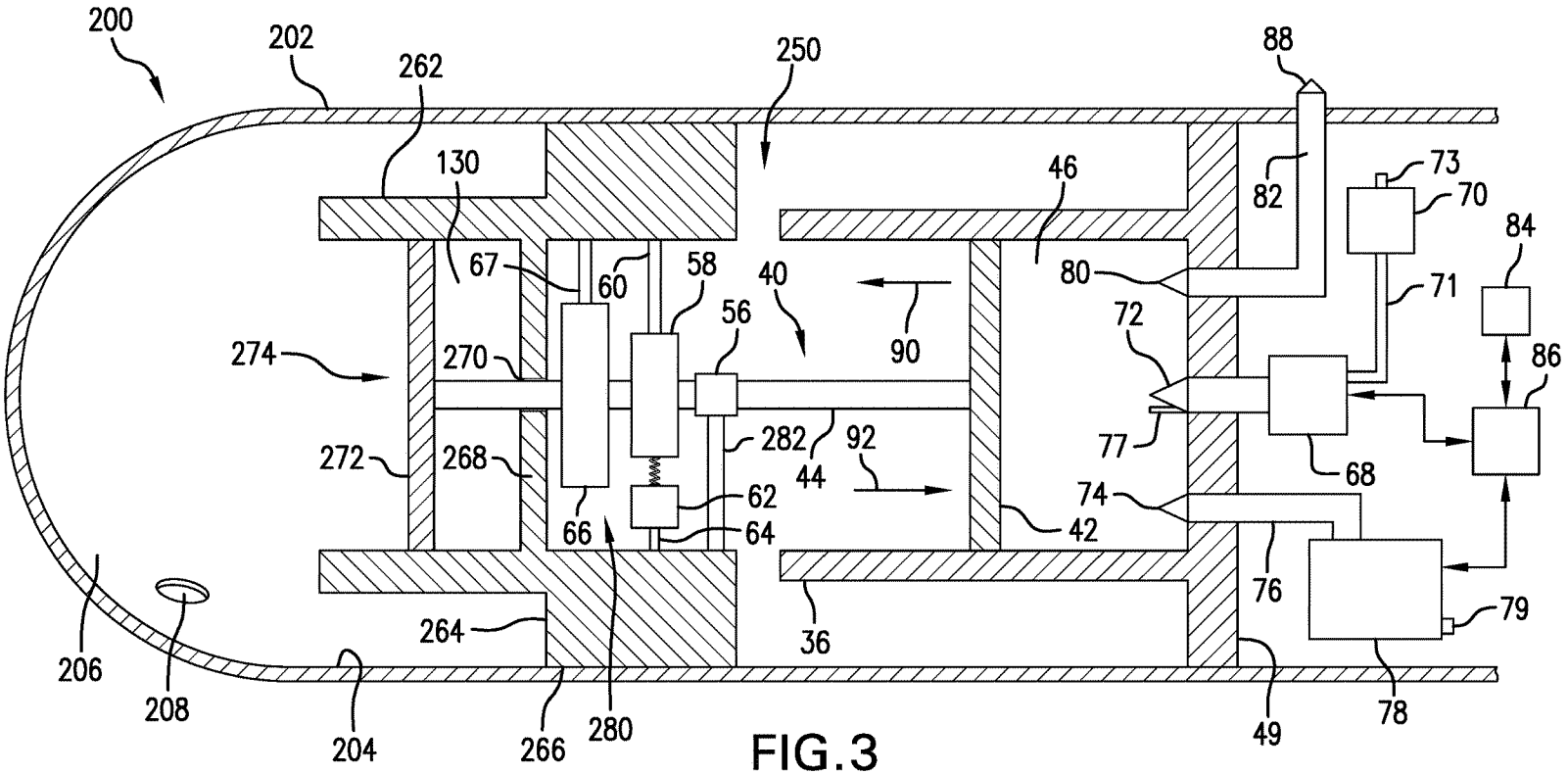
FIG. 3 is a cross-sectional view of a portion of a submersible object utilizing a buoyancy control system in accordance with another embodiment of the present invention.

Referring to FIG. 3, there is shown submersible object 200 that utilizes another embodiment of the buoyancy control system of the present invention, indicated by reference numeral 250. Submersible object 200 includes hull 202 which has interior wall 204. Submersible object 200 includes interior region 206 that is in the forward portion of the submersible object 200. Hull 202 includes opening 208 that provides the same function as opening 50 shown in FIG. 1. External ambient fluid (e.g., ocean or sea water) flows into interior region 206 via opening 208. Buoyancy control system 250 includes many of the components used in buoyancy control system 32 shown in FIG. 1. Therefore, like numerals in FIG. 3 refer to the same components shown in FIG. 1. Buoyancy control system 250 includes additional piston cylinder 262. Additional piston cylinder 262 comprises bulkhead 264. Bulkhead 264 includes annular surface 266 that is attached to interior wall 204 of hull 202. Bulkhead 264 includes wall section 268. Shaft portion 44 extends through an opening 270 in wall section 268. In one embodiment, a seal device (not shown) is located in opening 270 that allows axial movement of shaft portion 44 but prevents any fluids from additional piston cylinder 262 leaking into the portion of the interior of submersible object 200 where important components are located. Buoyancy control system 250 further includes additional piston 272 that is attached to the end of shaft portion 44 and is located within piston cylinder 262. Additional piston cylinder 262 and additional piston 272 define ambient chamber 274. The volume of ambient chamber 274 decreases when additional piston 272 is displaced in first direction 90. The volume of ambient chamber 274 increases when additional piston 272 is displaced in opposite second direction 92. Movement of shaft portion 44 in opposite second direction 92 causes displacement of additional piston 272 in the same direction which in turn causes ambient fluid to flow into ambient chamber 274. Therefore, a decrease in the buoyancy of submersible object 200 causes ambient fluid to flow into ambient chamber 274. Movement of shaft portion 44 in first direction 90 causes displacement of additional piston 272 in the same direction which in turn causes ambient fluid to flow out of ambient chamber 274. Thus, an increase in buoyancy of submersible object 200 causes ambient fluid to flow out of ambient chamber 274 which in turn causes ambient fluid to exit interior region 206 via opening 208. The ambient fluid exiting opening 208 flows into the environment external to submersible object 200.

Bulkhead 264 defines region 280 in which are located position sensor 56, brake mechanism 58, brake control device 62 and actuator device 66. These devices function in the same manner as previously described herein with respect to FIG. 1 and are therefore not discussed in detail. Position sensor 56 is supported by support member 282. Support member 282 is attached to bulkhead 264.

Figure 4:
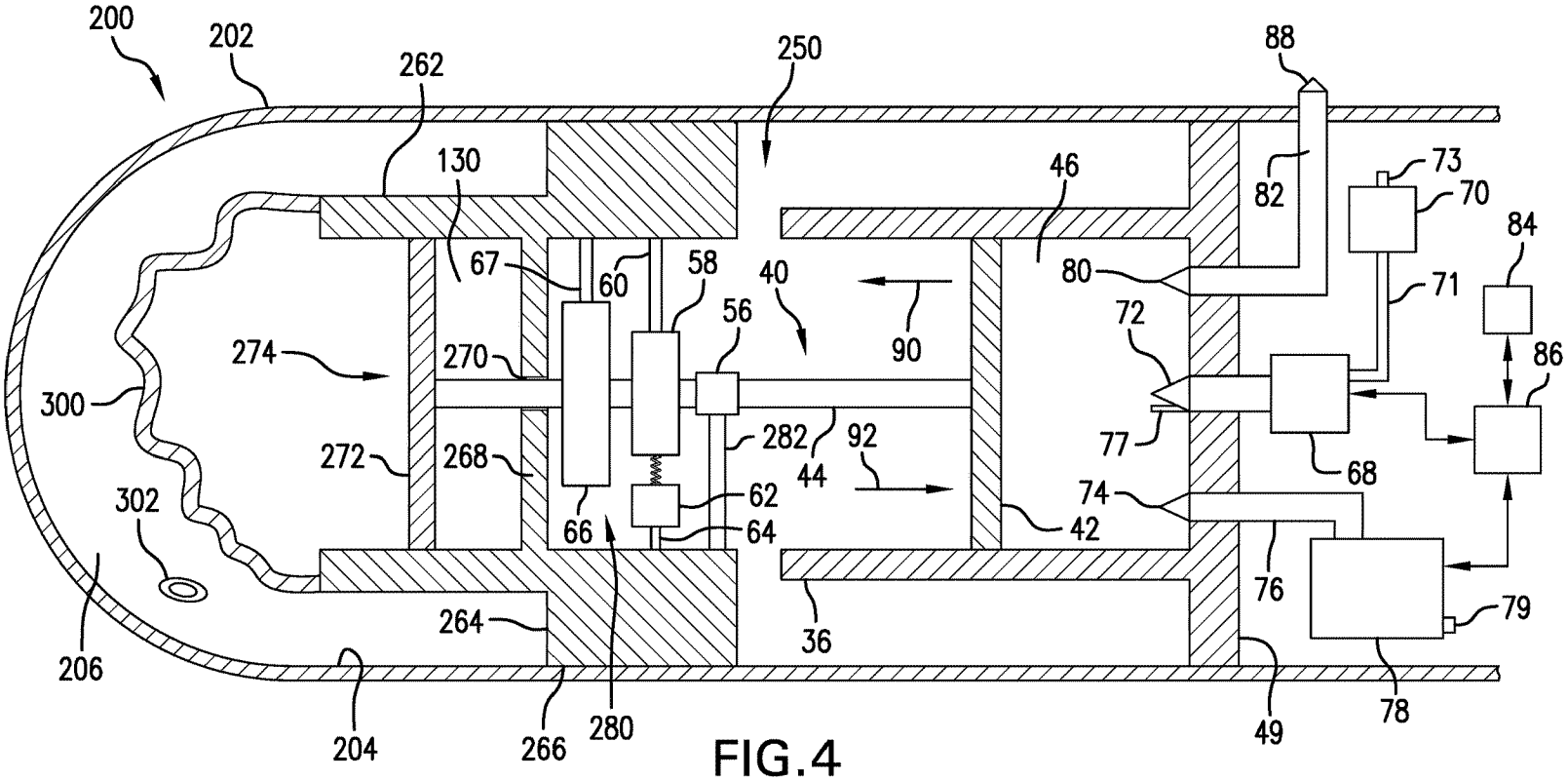
FIG. 4 is a cross-sectional view of the same portion of the submersible object of FIG. 3 wherein the buoyancy control system includes an expandable bladder in accordance with another embodiment of the present invention.

Referring to FIG. 4, buoyancy control system 250 may optionally use expandable bladder 300. Expandable bladder 300 functions in the same manner as expandable bladder 100 shown in FIG. 2. Expandable bladder 300 is attached, joined or sealed to piston cylinder 262 so that the opening of expandable bladder 300 is in fluid communication with ambient chamber 274. In this embodiment, cap or plug 302 closes opening 208 so there is no sea water or ambient fluid in interior region 206. A predetermined amount of incompressible fluid is within ambient chamber 274 and is pushed into expandable bladder 300 when additional piston portion 272 is displaced in direction 90. Expandable bladder 300 expands as the incompressible fluid flows therein. When additional piston 272 is displaced in opposite second direction 92, the incompressible fluid flows from expandable bladder 300 back into ambient chamber 274. As the incompressible fluid leaves expandable bladder 300, the expandable bladder 300 slowly collapses. Expandable bladder 300 is made from any suitable material that allows for repeated expansion and collapse with minimal resistance.

Figure 5:
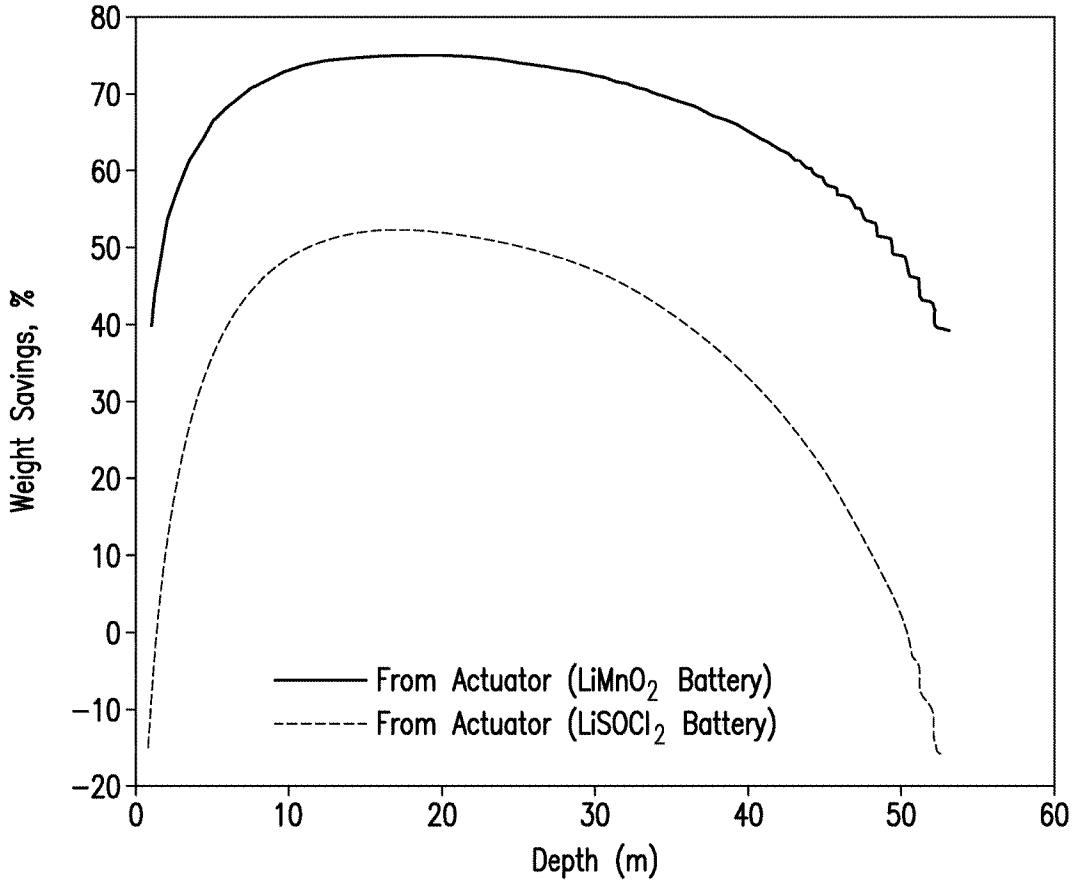
FIG. 5 is a graph that shows the weight difference between diesel fuel and Lithium batteries.

The buoyancy control system of the present invention provides many advantages and benefits. Referring to the graph in FIG. 5, significant weight savings are possible if a buoyancy control system employing diesel combustion is used instead of common "CR" batteries (i.e. lithium manganese dioxide, $LiMnO_2$). About 50% weight savings was achieved at depths of 2 m (meters) and 49 m, with a peak weight saving of about 75% at a depth of about 18 m. When a buoyancy control system employing diesel combustion is used in instead of the more energy dense "ER" batteries (i.e. lithium thionyl chloride, $LiSOCl_2$) and an electric actuator, the weight savings peaks at about 52% at a depth of 18 m. There are positive weight savings from about 1.5 m to about 50 m. These results are based on a naturally aspirated buoyancy control system with the oxidizer being air (see FIG. 7) and an ideal air analysis. Thus, compressed oxidizer from tank 78 is not used. Prior to descent, the air in combustion chamber 46 was at ambient pressure. These results are also independent of vehicle weight, speed and lift-to-drag ratio.

Figure 6:
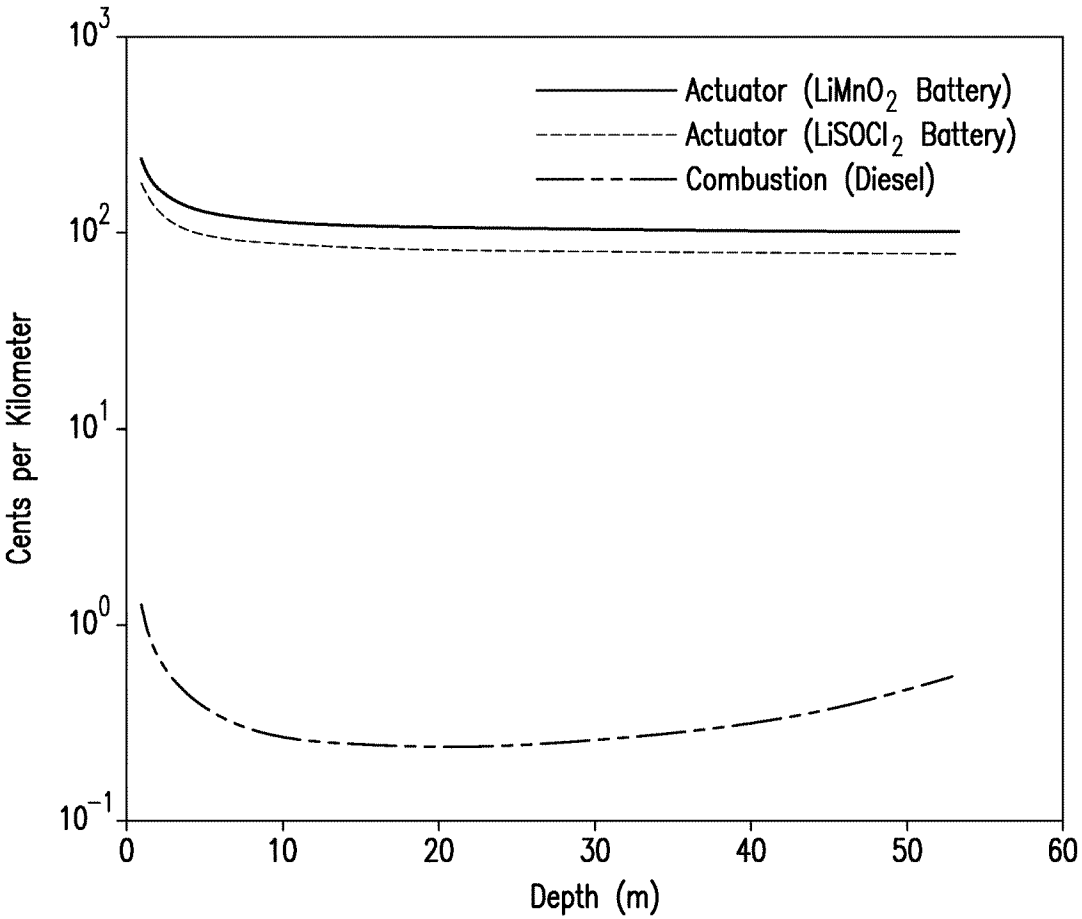
FIG. 6 is graph showing cost efficiency of energy storage as a function of depth for both diesel combustion and Lithium batteries.

FIG. 6 shows the cost efficiency of energy storage as a function of depth. For a buoyancy control system employing diesel combustion, a shallow minimum of 0.24 cents/km occurs at 17-23 m which is in stark contract with about 0.80 cents/km and 100 cents/km for the ER and CR batteries, respectively. This data is based on the premise that the glider or submersible object travels 0.25 m/s for one year for a total distance of 7900 km. These results are dependent upon the vehicle weight, speed and lift-to-drag ratio. These results are based on a naturally aspirated buoyancy control system with the oxidizer being air (see FIG. 7) and an ideal air analysis. Thus, compressed oxidizer from tank 78 is not used. Prior to descent, the air in combustion chamber 46 was at ambient pressure.

Although the foregoing description is in terms of diesel fuel being used to produce combustion, it is to be understood that other suitable fuels may be used to create combustion. For example, propane gas may be used instead of diesel fuel.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A buoyancy control system for a submersible object configured for submergence in an ambient fluid, comprising:

a piston cylinder;

a piston member including a piston portion and a shaft portion attached to the piston portion, wherein the piston portion is supported within the piston cylinder such that the piston portion and piston cylinder define a combustion chamber, wherein the combustion chamber has a volume that is determined by the position of the piston portion within the piston cylinder;

an oxidizer inlet attached to the piston cylinder to introduce oxidizer into the combustion chamber;

a fuel injector and igniter device attached to the piston cylinder to inject fuel into the combustion chamber so that it mixes with the oxidizer in the combustion chamber and ignite the mixture of oxidizer and fuel in the combustion chamber; and an exhaust outlet attached to the piston cylinder to vent combustion gases from the combustion chamber;

whereby the combustion within the combustion chamber displaces the piston member in a first direction causing an increase in the volume of the combustion chamber which in turn increases the buoyancy of a submersible object and displacement of the piston member in a second opposite direction causes a decrease in the volume of the combustion chamber which in turn decreases the buoyancy of the submersible object.

2. The buoyancy control system according to claim 1 further comprising a brake mechanism having a first state that allows the shaft portion to axially move only in the first direction and a second state that allows the shaft portion to axially move in either the first direction or the opposite second direction.

3. The buoyancy control system according to claim 2 further comprising a brake control device that configures the brake mechanism in either the first state or the second state.

4. The buoyancy control system according to claim 3 further comprising an actuator device that has a first state of operation wherein the actuator device axially moves the shaft portion to cause displacement of the piston portion in the first direction and a second state of operation wherein the actuator device axially moves the shaft portion to cause displacement of the piston portion in the opposite second direction.

5. The buoyancy control system according to claim 4 further comprising a conduit that is connected to the oxidizer inlet and which has a first portion within the submersible object and a second portion that is external to the submersible object, the second portion including a one-way valve to allow air to be drawn into the conduit when the submersible object surfaces and the actuator device is in the first state of operation.

6. The buoyancy control system according to claim 4 further comprising a controller programmed to generate control signals that control the brake control device and actuator device.

7. The buoyancy control system according to claim 6 wherein the controller is programmed to activate the fuel injector and igniter device to inject fuel into the combustion chamber and ignite the mixture of fuel and oxidizer in the combustion chamber.

8. The buoyancy control system according to claim 7 further comprising a depth sensor in electrical signal communication with the controller.

9. The buoyancy control system according to claim 8 further comprising a position sensor in electronic signal communication with the controller.

10. The buoyancy control system according to claim 1 further including a fuel pump to provide fuel to the fuel injector and igniter device.

11. The buoyancy control system according to claim 10 further including a fuel tank that is in fluid communication with the fuel pump and which contains an amount of fuel.

12. The buoyancy control system according to claim 11 wherein the fuel tank includes a valve that allows the fuel tank to be replenished with fuel.

13. The buoyancy control system according to claim 1 further comprising a source of compressed oxidizer in gaseous communication with the oxidizer inlet.

14. The buoyancy control system according to claim 1 wherein the submersible object has a hull having an interior wall and wherein the piston cylinder comprises a bulkhead that is attached to the interior wall of the hull.

15. The buoyancy control system according to claim 1 wherein the fuel is diesel fuel.

16. The buoyancy control system according to claim 14 wherein the oxidizer inlet, fuel injector and igniter device and exhaust outlet are attached to the bulkhead.

17. The buoyancy control system according to claim 1 wherein the submersible object has a hull, an interior area within the hull and an opening in the hull that allows ambient fluid outside the submersible object to flow into the interior area, wherein the piston portion and piston cylinder also define an ambient chamber and wherein displacement of the piston portion in the opposite second direction causes the ambient fluid in the interior area to flow into the ambient chamber and displacement of the piston portion in the first direction pushes ambient fluid out of the ambient chamber thereby forcing an amount of ambient fluid in the interior area to flow out through the opening in the hull and into the environment outside of the submersible object.

18. The buoyancy control system according to claim 1 wherein the piston portion and piston cylinder also define an ambient chamber and the buoyancy control system further includes an expandable bladder attached to the piston cylinder such that the expandable bladder is in fluid communication with the ambient chamber, wherein the ambient chamber is filled with incompressible fluid that is pushed into the expandable bladder when the piston portion is displaced in the first direction and wherein the incompressible fluid flows back into the ambient chamber when the piston portion is displaced in the second opposite direction.

19. The buoyancy control system according to claim 1 wherein the submersible object has a hull, an interior area within the hull and an opening in the hull that allows ambient fluid outside the submersible object to flow into the interior area, the buoyancy control system further comprising:

an additional piston cylinder, wherein the shaft portion extends into the additional piston cylinder; and an additional piston located in the additional piston cylinder and attached to the shaft portion such that axial movement of the shaft portion displaces the additional piston, wherein the additional piston cylinder and additional piston define an ambient chamber and wherein the volume of the ambient chamber decreases when the additional piston is displaced in the first direction and increases when the additional piston is displaced in the opposite second direction, wherein displacement of the additional piston in the opposite second direction causes ambient fluid in the interior area to flow into the ambient chamber and displacement of the additional piston in the first direction pushes ambient fluid out of the ambient chamber and thereby forcing an amount of ambient fluid in the interior area to flow out through the opening in the hull and into the environment outside of the submersible object.

20. The buoyancy control system according to claim 1 further comprising:

an additional piston cylinder, wherein the shaft portion extends into the additional piston cylinder;

an additional piston located in the additional piston cylinder and attached to the shaft portion such that axial movement of the shaft portion displaces the additional piston, wherein the additional piston cylinder and additional piston define an ambient chamber and wherein the volume of the ambient chamber decreases when the additional piston is displaced in the first direction and increases when the additional piston is displaced in the opposite second direction; and an expandable bladder attached to the additional piston cylinder such that the expandable bladder is in fluid communication with the ambient chamber, wherein the ambient chamber is filled with incompressible fluid that is pushed into the expandable bladder when the additional piston is displaced in the first direction and wherein the incompressible fluid flows back into the ambient chamber when the additional piston is displaced in the second opposite direction.

* * * * *